US005439261A

United States Patent [19]

O'Hare

[11] Patent Number: 5,439,261

[45] Date of Patent: Aug. 8, 1995

[54] VEHICULAR DOOR LOCK HAVING SUPER-LOCK MECHANISM

[75] Inventor: Paul W. O'Hare, Yamanashi, Japan

[73] Assignee: Mitsui Kinzoku Kogyo Kabushiki Kaisha, Tokyo, Japan

[21] Appl. No.: 111,157

[22] Filed: Aug. 24, 1993

[30] Foreign Application Priority Data

Aug. 24, 1992 [JP] Japan ..... 4-247363

[51] Int. Cl.[6] ..... E05B 3/00

[52] U.S. Cl. ..... 292/336.3; 292/201

[58] Field of Search ..... 292/336.3, 201, 74; 70/264, 240

[56] References Cited

U.S. PATENT DOCUMENTS

| | | | |
|---|---|---|---|
| 3,566,703 | 3/1971 | Noord | 292/201 |
| 4,342,209 | 8/1982 | Kleefeldt . | |
| 4,723,454 | 2/1988 | Periou et al. | 74/89.15 |
| 4,872,714 | 10/1989 | Brusasco | 292/201 |
| 4,978,154 | 12/1990 | Kleefeldt et al. . | |
| 4,982,986 | 1/1991 | Gressett, Jr. et al. | 292/336.3 |
| 5,007,261 | 4/1991 | Quantz | 70/240 |
| 5,078,436 | 1/1992 | Kleefeldt et al. | 292/201 |
| 5,149,156 | 9/1992 | Kleefeldt | 292/336.3 |

*Primary Examiner*—Peter M. Cuomo
*Assistant Examiner*—Monica E. Millner
*Attorney, Agent, or Firm*—Browdy and Neimark

[57] ABSTRACT

A super-lock mechanism for a vehicular door lock device has a sector arm rotatable by a motor and provided with a first long hole and a second long hole, a lock lever engageable with the first long hole of the sector arm, a movement member connected to the lock lever, a block member movable by the motor, and a slider having an end engageable with the second long hole and another end engageable with a dent of the block member. When the sector arm displaces the lock lever to its locked position, the movement member and slider move in a transversal direction and the block member in a generally longitudinal direction. Additionally, a head portion of the block member engages with a dent of the movement member and another end of the slider engages with a dent of the block member attaining the super-lock condition. In such super-lock condition of the door lock device, when the sector arm rotates in its unlocking direction, the second long hole engages with the one end of the slider and its other end disengages from a dent of the block member before the first long hole engages with the lock lever.

3 Claims, 13 Drawing Sheets

VEHICULAR DOOR LOCK HAVING SUPER-LOCK MECHANISM

TECHNICAL FIELD OF THE INVENTION

The present invention relates to a super-lock mechanism of a vehicular door lock device. The super-lock mechanism means one for preventing the lock device from exchanging to its unlocked condition even though an inside lock member of the door operates.

PRIOR ART

Many super-lock mechanisms which have been proposed. These are generally divided into two kinds, i.e. a block type described in U.S. Pat. No. 4,342,209 for precluding motion of an inside lock member, and of a missing type described in U.S. Pat. No. 4,978,154. The present invention relates to the former kind of block type.

The conventional super-lock mechanism described in U.S. Pat. No. 4,342,209 has an operator moved by a motor from its unlocked position to the super-lock position through a locked position, and a slider connected to a lock lever. When the motor moves the operator from the unlocked position to the locked position, a projection of the operator engages with a Spring biased pivotal lever in order to move the slider to its locked position. When the operator moves further to the super-lock position, the projection of the operator overcomes the pivotal lever and engages with a pawl of the slider, resulting in an engagement of the pawl pressed from the projection with a dent portion of a housing. Such engagement of the pawl and the dent portion makes the slider unable to displace from its locked position resulting in a super-lock condition of the vehicular door lock device.

According to problems of the conventional door lock device, it is possible to confirm the locked condition of the device, but impossible to confirm its super-lock condition. According to the structures of the prior art above, when the motor exchanges the operator from its unlocked position to its locked position, the inside lock member also cooperatively moves from its unlocked position to the locked position. It is possible to confirm the locked condition of the mechanism by seeing the inside lock member. However, it is impossible to confirm the super-lock condition of the mechanism, before the inside lock member practically is operated, because the particular members to be moved attaining a super-lock condition is not seen.

PURPOSE OF THE INVENTION

It a purpose of the present invention is to provide a super-lock mechanism used in a vehicular door lock device adapted to attain simultaneously a super-lock condition of the lock device when the motor exchanges the lock device to its locked condition.

It another purpose of the present invention is to provide such super-lock mechanism adapted to release only in its super-lock condition.

PREFERRED EMBODIMENT

Figure 1:
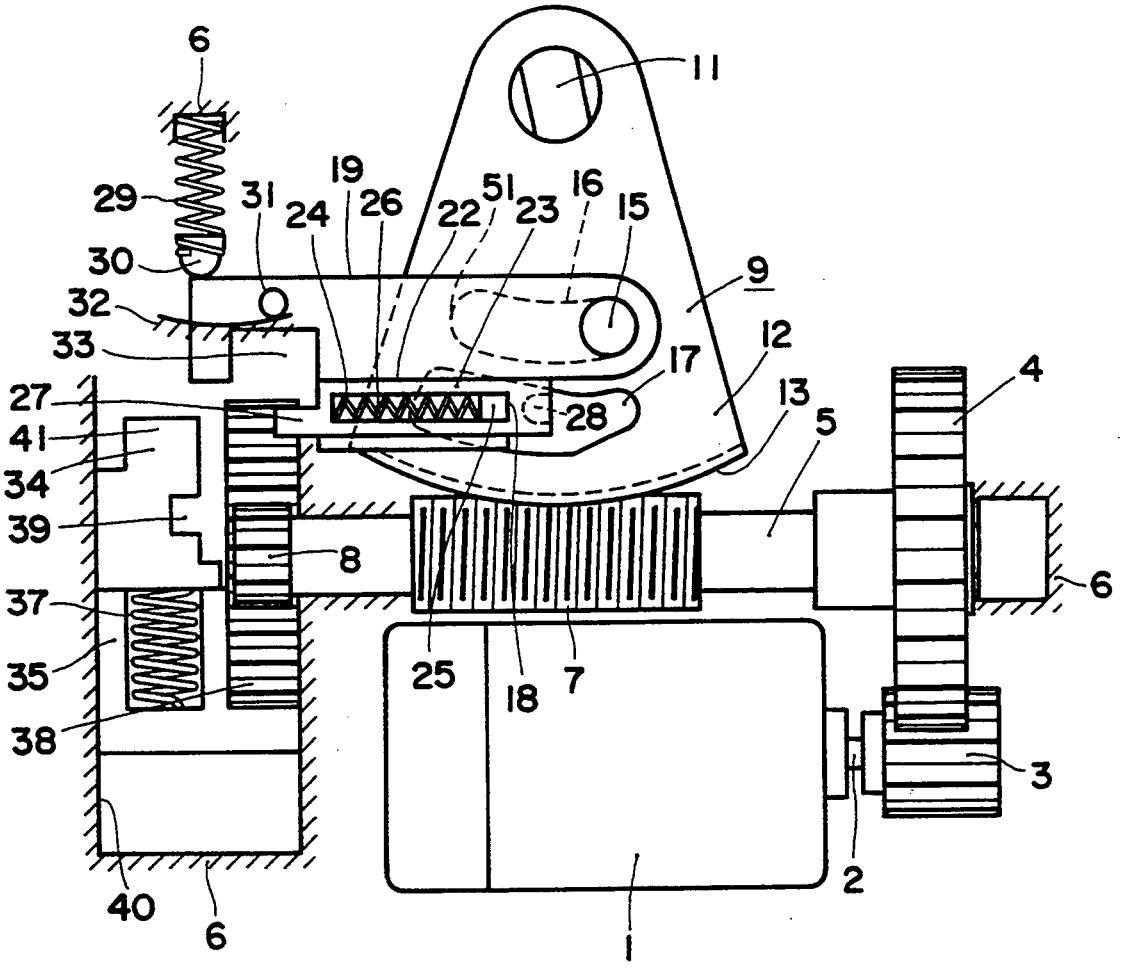
FIG. 1 is a plan view of the actuator at its unlocked condition.

An embodiment of the vehicular door lock device with a super-lock mechanism according to the present invention will be described with the accompanying drawings. FIG. 1 to FIG. 5 show the actuator portion to be attached to the door lock device and a drive gear 3 is fixed to an output shaft 2 of a motor 1 attached to a case 6. A rotary shaft 5 is rotatably held at the case 6. A gear 4 engaging with the drive gear 3 is attached to an end of the rotary shaft 5 and a pinion 8 is held on another end of the shaft 5. A worm gear 7 is installed at a mid position between the ends of the rotary shaft 5.

Figure 9:
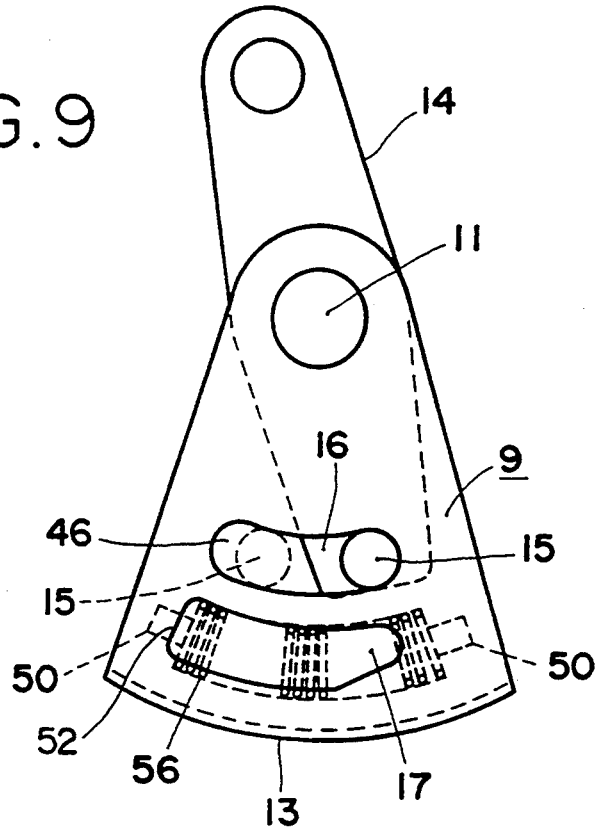
FIG. 9 is a plan view of the fan shaped arm and a rotation lever.

A fan shaped arm 9 rotatably held on the output shaft 11 of the actuator has on its circumferential portion 12 a toothed portion 13 engageable with the worm gear 7. A revolving lever 14 is fixed to the output shaft 11 as shown in FIG. 9. A boss 15 (or output member) is installed at an end portion of the revolving lever 14 and the boss 15 engages with an arc-like opening 16 formed in the fan shaped arm 9 with a radial diameter from the output shaft 11. When the motor 1 rotates, the fan shaped arm 9 rotates around the output shaft 11 because the gear 7 engages with the toothed portion 13. When the fan shaped arm 9 rotates and the arc-like opening 16 engages with the boss 15, the revolving lever 14 rotates integrally together with the output shaft 11.

Figure 4:
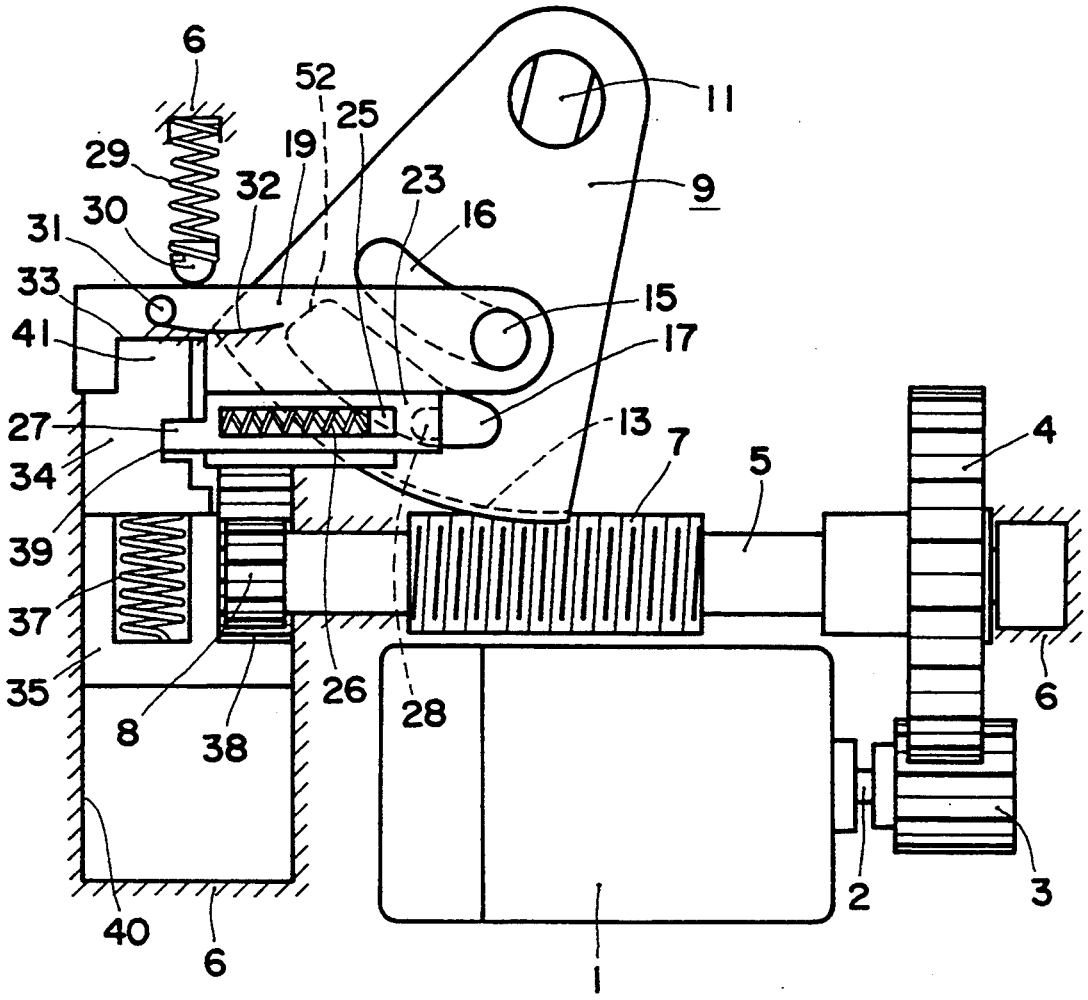
FIG. 4 is a plan view of the actuator when its link engages with a block member.
Figure 7:
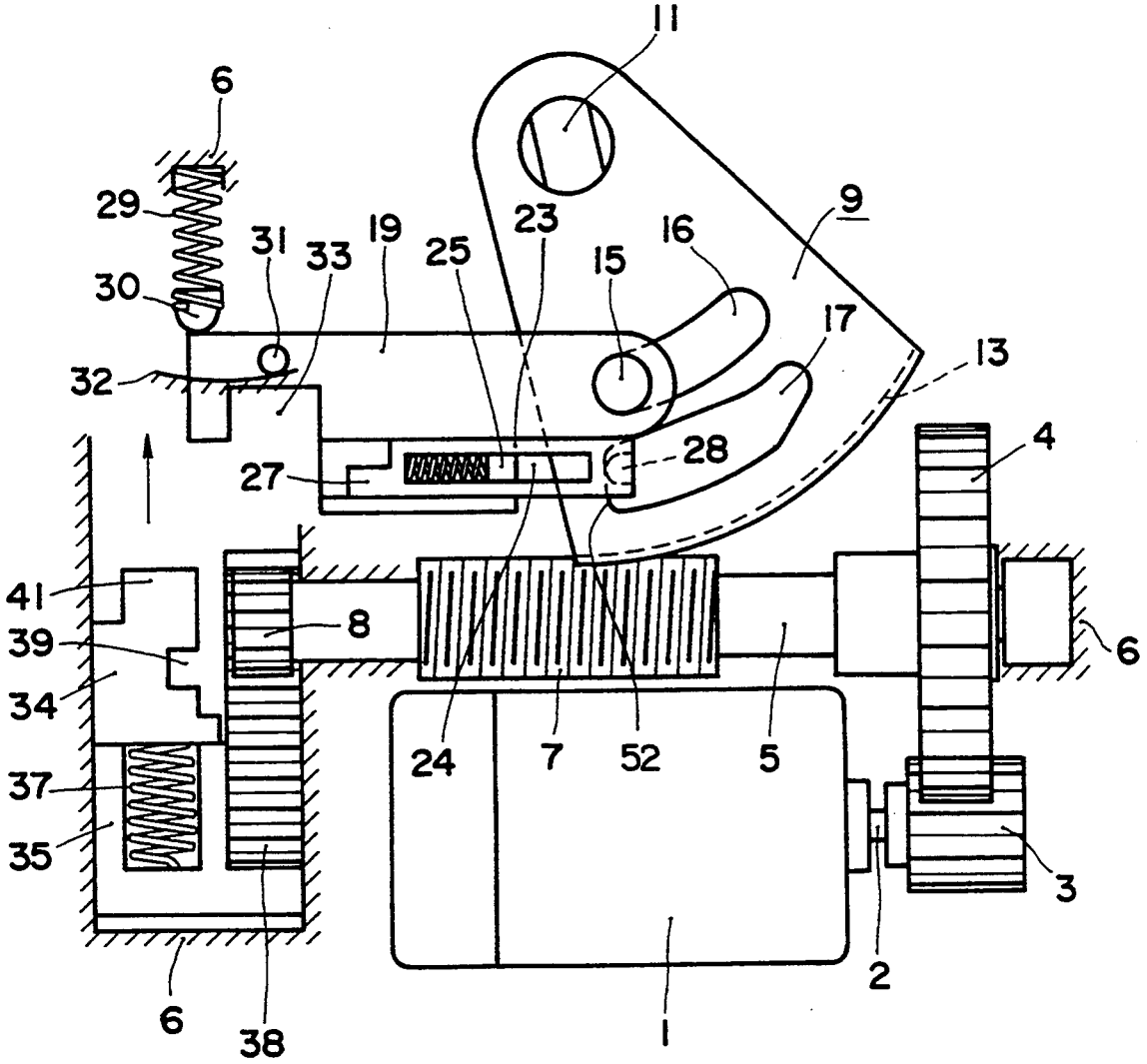
FIG. 7 is a plan view of the actuator when its fan shaped arm rotates in an unlocking direction.
Figure 10:
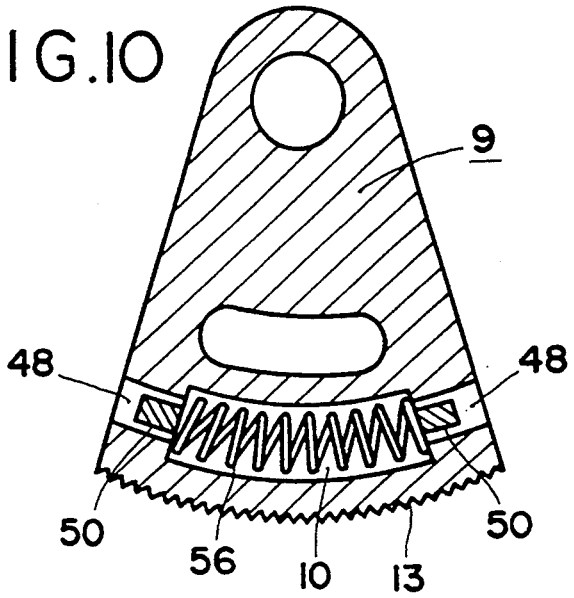
FIG. 10 is a transversal section of the fan shaped arm showing a neutral return mechanism.

A rear side of the fan shaped arm 9 has a grab or glove 10 as shown in FIG. 10 and a neutral return spring 56 (or second spring) is contained in the glove 10. Then passages 48 are formed at both ends of the glove 10 and a pair of protrusions 50 integrally formed with the case 6 is entered in the passages 48. As shown in FIG. 4 and FIG. 7, the neutral return spring 56 functions to return the fan shaped arm 9 rotated by the motor 1 to its neutral position. The neutral return mehanism using a spring 56 is well known.

Figure 5:
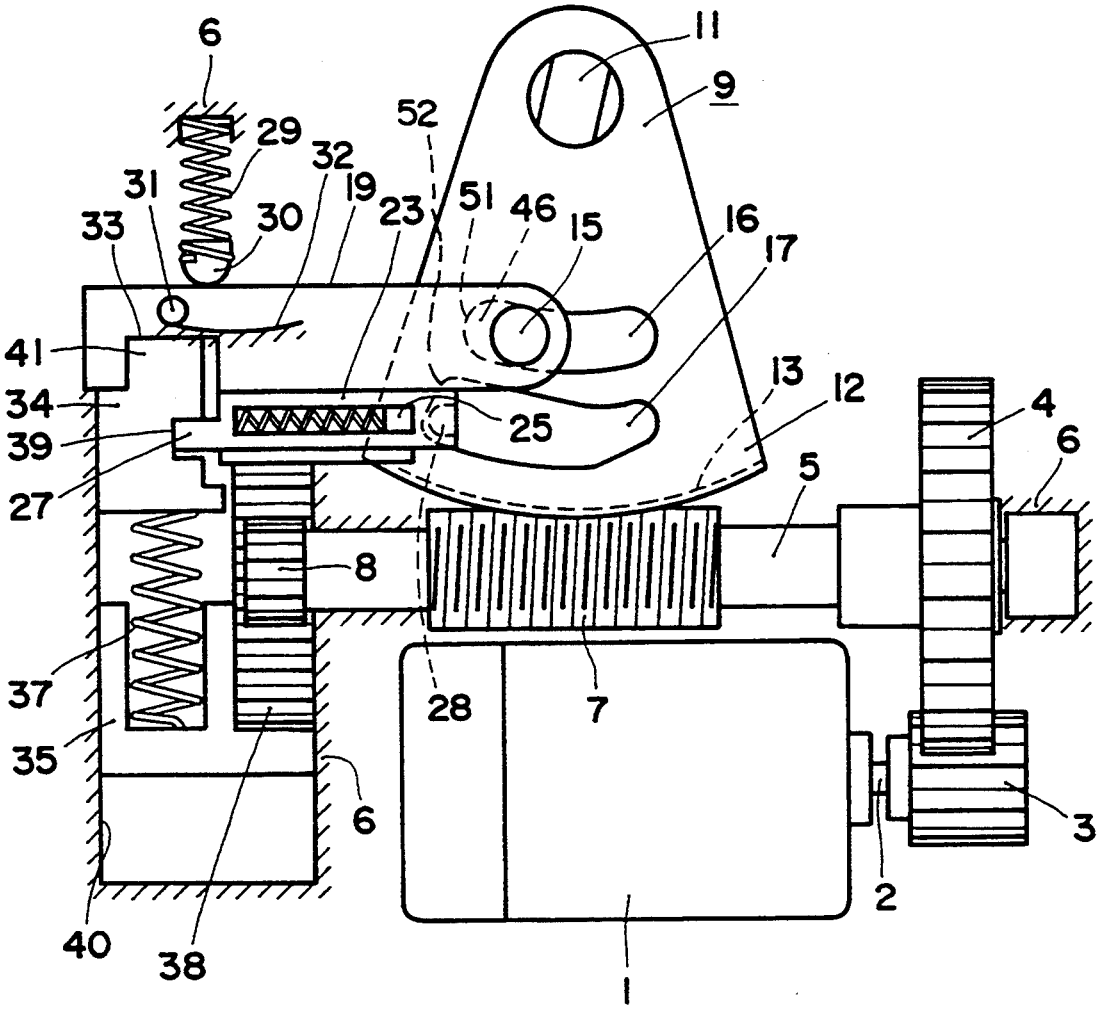
FIG 5 is a plan view of the actuator super-locked.
Figure 11:
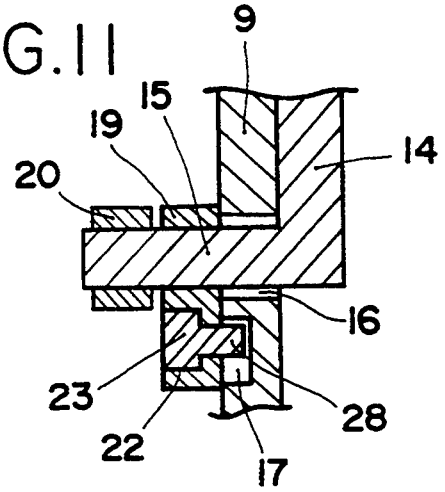
FIG. 11 is an enlarged section of the important portion of the actuator.
Figure 15:
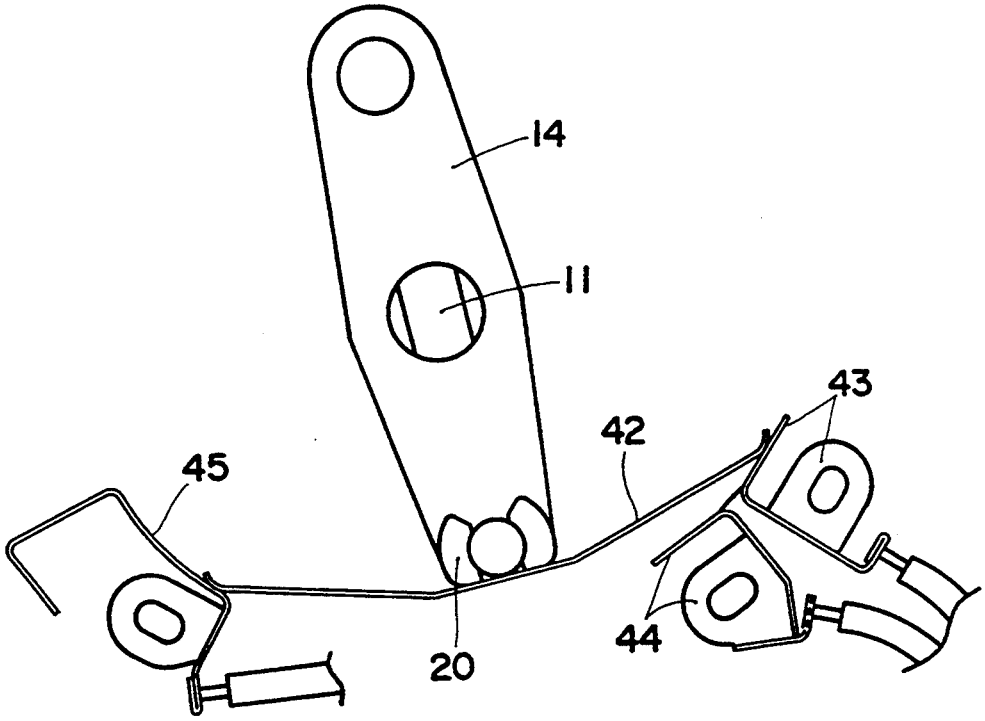
FIG. 15 shows a relation between a rotary lever and the switch.

A lock lever 62 of the lock device which will be described is fixed to the output shaft 11 and the lock lever 62 and the revolving lever 14 are constructed so as to displace integrally. As well known, the lock lever 62 and the revolving lever 14 can exchange between their locked position and the unlocked position. According to the embodiment of the present invention, when the boss 15 of the revolving lever 14 is placed at the right of the arc-like opening 16 of the fan shaped arm 9 placed at its neutral position, the lock device is at its unlocked condition (FIG. 11). When the boss 15 is placed at the left, the lock device is placed at its locked condition (FIG. 15). The length of the arc shaped opening or hole 16 is longer than a displacement value or distance of the boss 15. As shown in FIG. 5, a predetermined gap 46 is formed between the boss 15 at its locked position and a left wall 51 of the arc shaped opening 16.

Figure 8:
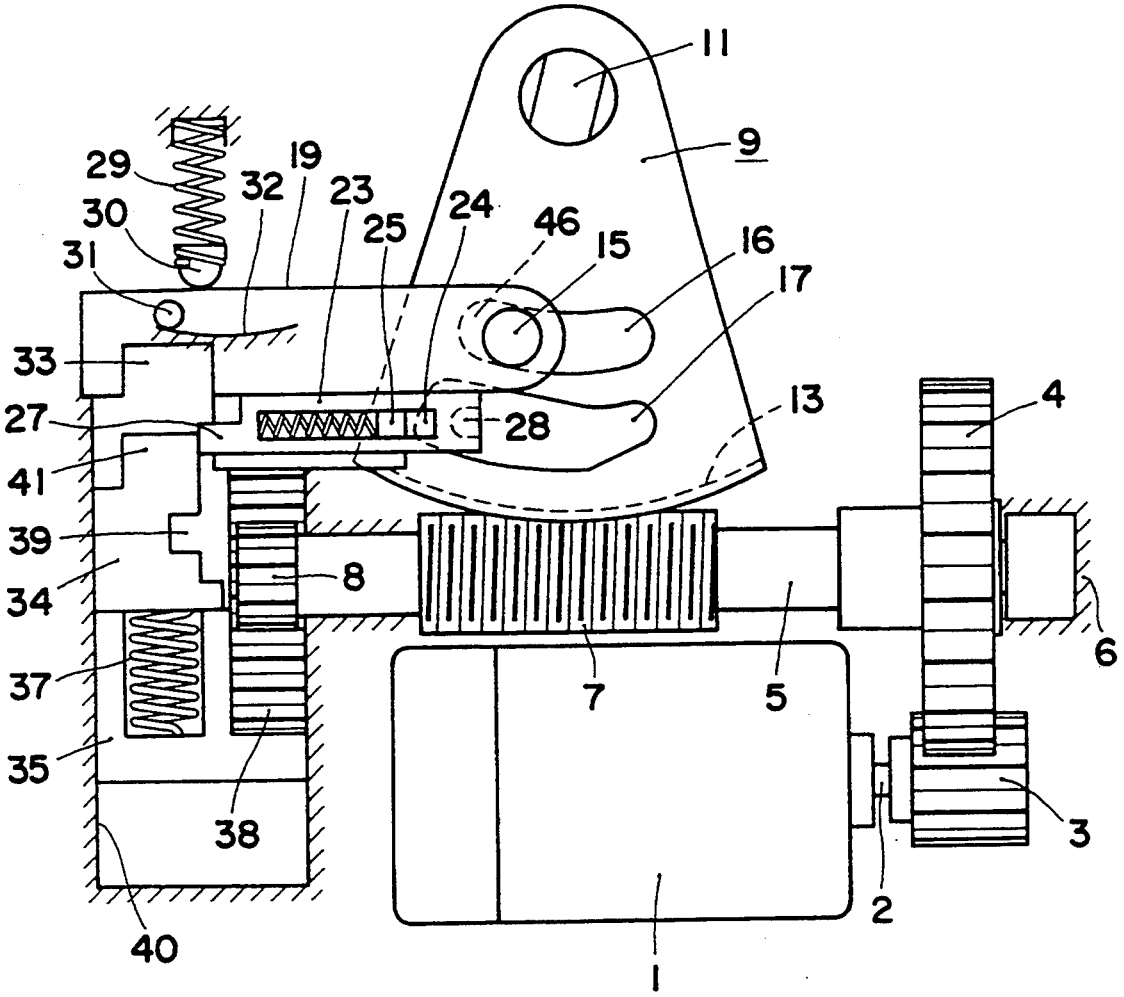
FIG. 8 is a plan view of the actuator at its locked condition.

As shown in FIG. 11, the boss 15 protrudes through the arc shaped opening 16. The protruded end of the boss 15 is rotatably connected to the right side of a transversal link 19 in parallel generally to the rotary shaft 5. A left side of the link 19 is constantly pressed downwardly by a pressing body 30 attached to the spring 29. The link 19 pressed by the spring 29 is stopped when the pin 31 of the link 19 engages with a shelf 32 formed on the case 6. As shown in FIG. 8, the shelf 32 has a curved shape. The link 19 moves along a general-transversal direction when the revolving lever 14 rotates around the shaft 11.

Figure 12:
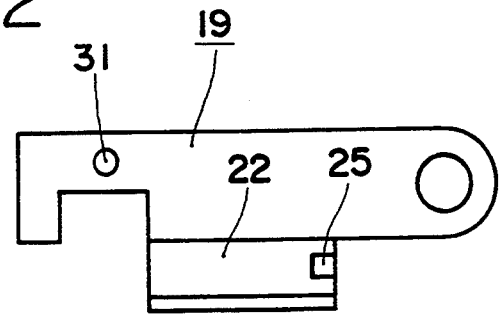
FIG. 12 is a plan view of the link.
Figure 13:
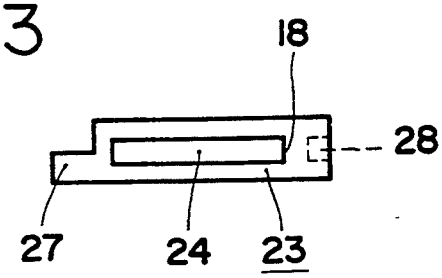
FIG. 13 is a plan view of the slider.

As shown in FIG. 12, the link 19 has a transversal guide groove 22 in which a slider 23 (or engagement body) is slidably held by a protrusion 25 extending into the long hole 24 extending horizontally in the slider 23, the protrusion being formed at the right end of the guide groove 22. The slider 23 is urged to the left in FIG. 1 owing to a function of the spring 26 installed in the long hole 24. The slider 23 stops when the right wall 18 of the slider 23 engages with the protrusion 25. A protrusion 27 extending to the left of the guide groove 22 when the right wall 18 engages with the protrusion 25 is formed at the left end of the slider 23.

A protrusion 28 engageable with a long groove 17 of the fan shaped arm 9 is formed at the right end of the slider 33. As shown in FIG. 5, the long goove 17 and, the protrusion 28 are set so as to just engage the protrusion 28 with the left wall 52 of the long groove 17 when the revolving lever 14 is displaced to its locked position. Accordingly, when the fan shaped arm 9 rotates counterclockwise from the condition shown in FIG. 5, first the left wall 52 of the long groove 17 engages with the protrusion 28 and the slider 23 moves to the right compressing the spring 26, then the left wall 51 of the arc shaped opening 16 engages with the boss 15 moving the link 19 to the right.

A vertical guide groove 40 is formed at the left side of the case 6. A pressing body 35 is attached in the guide groove 40 so as to move in an up-and-down direction. A rack gear 38 engageable with the pinion 8 is attached to the pressing body 35. When the pinion 8 rotates, the pressing body 35 moves in an up-and-down direction within the guide groove 40. A block member 34 is mounted on the upper face of the pressing body 35. The spring 37 (or first spring) has an end engaged with the pressing body 35 and another end engaged to the block member 34 and attracts the block member 34 to the top face of the pressing body 35.

A head portion 41 is formed on the top portion of the block member 34 and a notched portion 33 is formed on the link 19 with which notched portion 33 the head portion 41 is engaged. When the motor 1 rotates the fan shaped arm 9 clockwise from its condition shown in FIG. 1, the arc-like opening 16 engages with the boss 15 and the link 19 as a result moves to the left. Simultaneously, the pressing body 35 and the block member 34 respectively move upward and as shown in FIG. 2 the head portion 41 of the lock member 34 engages with a lower face of the link 19. Further, when the motor 1 rotates, the link 19 is raised by the head portion 41, the protrusion 27 of the slider 23 engages with a side wall of the head portion 41 and moves to the right against the elasticity of the spring 26 becoming the condition shown in FIG. 3. In this condition, the notched portion 33 of the link 19 is placed above the head portion 41 of the block member 34, so that the link 19 lowers owing to function of the spring 29 making the head portion 41 engage with the notched portion 33. When the head portion 41 enters into the notched portion 33, the protrusion 27 of the slider 23 faces a dent 39 of the block member 34. When the slider 23 moves to the left owing to elasticity of the spring 26, the protrusion 27 engages with the dent 39. When the protrusion 27 engages with the dent 39, the block member 34 is prevented from lowering, so that engagement of the head portion 41 with the notched portion 33 is kept preventing the link 19 from moving to the right. Consequently, the locked position is kept. It is the super-lock condition.

As shown in FIG. 15, a forked portion 20 is rotatably fixed to the boss 15 of the revolving lever 14. An end side of a contact 42 contacts selectively an unlocked position contact 43 and a locked position contact 44, an other end side of the contact 42 contacts a common contact 45.

Figure 14:
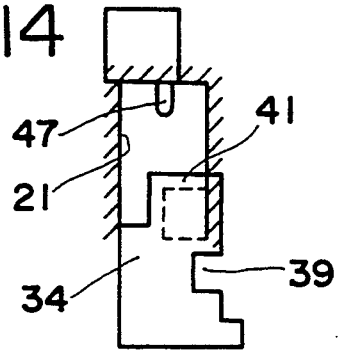
FIG. 14 shows a relation between the block member and a switch.

As shown in FIG. 14, a second groove 21 guiding the block member 34 is formed above the guide groove 40 and a switch 47 is formed on the upper portion of the second groove 21, which switch 47 being adapted to be pressed when the block member 34 moves upward.

Figure 16:
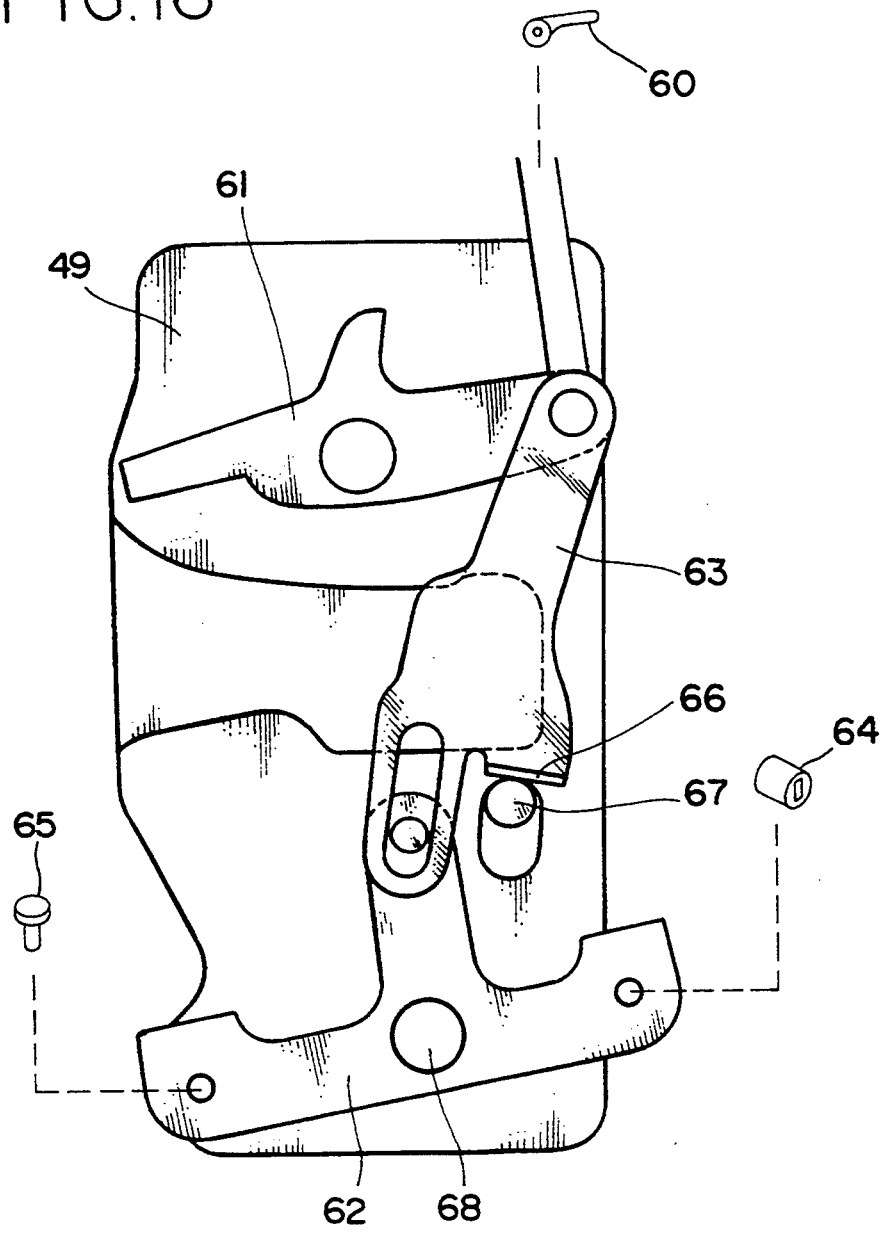
FIG. 16 is a plan view of the lock device.

FIG. 16 shows a conventional lock device. The lock body 49 has an opening lever 61 connected to an opening handle 60 of the vehicular door, a lock lever 62, and a link 63 installed between the opening lever 61 and the lock lever 62. A key cylinder 64 and an inside lock member 65 are connected to the lock lever 62. The condition shown in FIG. 16 is an unlocked one, in which condition, when the opening handle 60 lowers the link 63, an engagement piece 66 of the link 63 engages with a pin 67 of the ratchet moving the ratchet. However, when the lock lever 62 rotates clockwise, the engagement piece 66 is left from the pin 67 attaining a locked condition. In order to attach the actuator according to the present invention to the lock device, it is preferable that the output shaft 11 is fixed to a rotary shaft 68 of the lock lever 62 or one end of the revolving lever 14 is connected to one end of the lock lever 62 by means of a pin so as to rotate the lock lever 62 and revolving lever 14 integrally.

OPERATION

Figure 2:
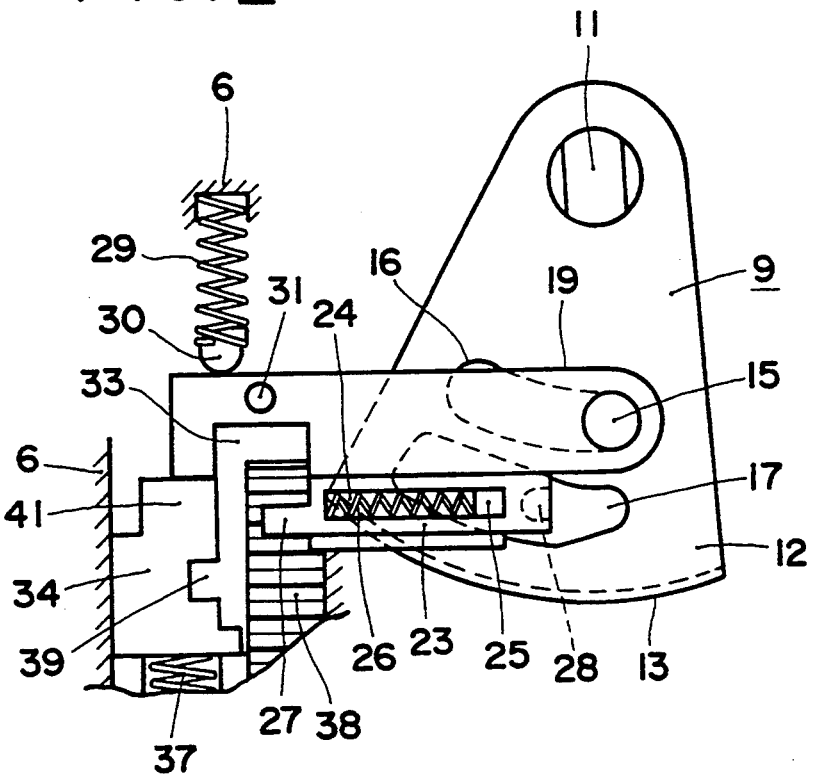
FIG. 2 is a plan view of a fan shaped arm when it rotates in a locking direction.

In the unlocked condition of the lock device of the present invention shown in FIG. 1, the fan shaped arm 9 is placed at its neutral position by means of the center returning spring 56 and the boss 15 of the revolving lever 14 is placed at the right end of the arc like opening 16. When the motor 1 rotates the rotary shaft 5 to the locking side, the worm gear 7 and the toothed portion 13 engage each other, the fan like arm 9 rotates clockwise and the right wall of the arc like opening 16 presses the boss 15 resulting in movement of the revolving lever 14 and the link 19 to the left. Simultaneously, an engagement of the pinion 8 and the rack gear 38 raises the pressing body 35 and the block member 34 resulting in as shown in FIG. 2 an engagement of the head portion 41 of the block meber 34 with the lower face of the link 19.

Figure 3:
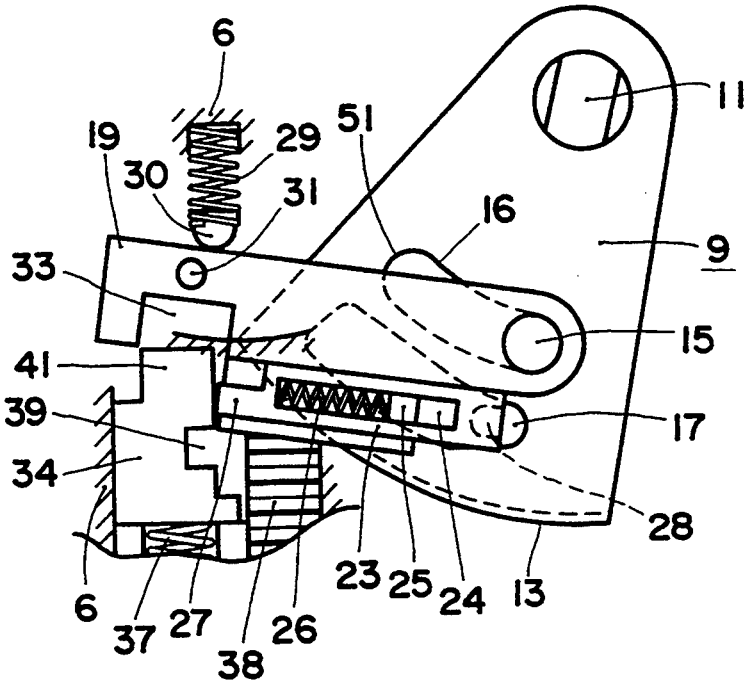
FIG. 3 is a plan view of the fan shaped arm just before being super-locked.

When the motor 1 further rotates, the link 19 is raised by the block member 34, the protrusion 27 of the slider 23 engages with the side wall of the head portion 41 and moves to the right against elasticity or resilient force of the spring 26 resulting in the condition shown in FIG. 3. In this condition, the notch 33 of the link 19 is placed above the head portion 41 of the block member 34, so that the link 19 lowers by function of the spring 29 resulting in an engagement of the notch 33 with the head portion 41 of the block member 34. When the head 41 engages with the notch 33, the link 19 returns to its generally horizontal position and the protrusion 27 of the slider 23 fades the dent 39 of the block member 34. Consequently, the slider 23 moves to the left owing to resilient force of the spring 26 and the protrusion 27 enters in the dent 39 of the block member 34 resulting in the condition of FIG. 4.

In the condition of FIG. 4, the head portion 41 of the block member 34 engages with the switch 47 (see FIG. 14) resulting in a stall or stop of electricity to the motor 1. As a result, as shown in FIG. 5 the fan shaped arm 9 rotates the rotary shaft 5 and returns to the neutral position owing to function of the center returning spring 56. Simultaneously, rotation of the rotary shaft 5 lowers the pressing body 35 through rotation of pinion 8 which moves rack gear 38 on pressing body 35, and the block member 34 fails to move except extension of the spring 37 because the block member 34 engages with the protrusion 27. The condition shown in FIG. 5 is the super-lock one, in which condition the link 19 engages with the block member 34. If someone or thief tries to wrongly move the lock lever 62, it is impossible to move the link 19 to the right and relief or open the lock by a wrong means.

Figure 6:
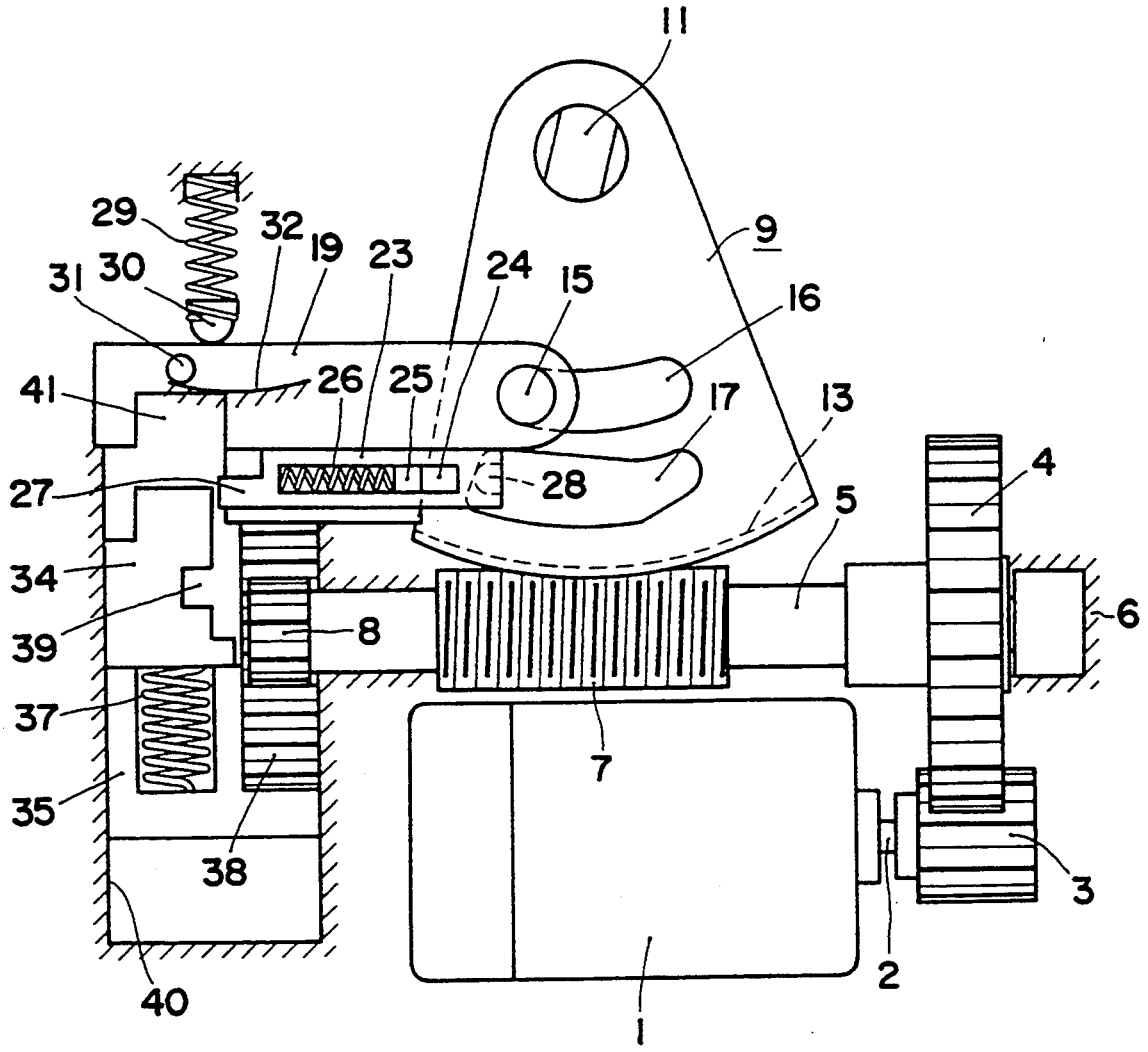
FIG. 6 is a plan view of the actuator after its super-lock is released.

When you want to cancel the super-lock condition, it is necessary to rotate the rotary shaft 5 by means of the motor 1 to the unlocking side. Thus, when shaft 5 is rotated to move arm 9 in a counter-clockwise direction slider 23 is disengaged from block member 34 out of the super-lock condition. Then, the fan shaped arm 9 rotates counterclockwise by the distance of the gap 46 formed between the boss 15 and the left wall of the arc like opening 16 and the left wall 52 of the long groove 17 pushes the protrusion 28 of the slider 23 to make the slider 23 move to the right. Consequently, the protrusion 27 of the slider 23 is taken off from the dent 39 of the block member 34. Then, as shown in FIG. 6, the block member 34 lowers due to function of the spring 37 resulting in a disengagement of the head portion 41 and the notch 33. In addition, when the block member 34 lowers, the switch 47 is turned off to stop the motor 1. And the fan shaped arm 9 returns to its neutral position and the super-lock condition of it is released becoming the locked condition shown in FIG. 8. In the condition shown in FIG. 8, the link 9 and the block member 34 are engaged with each other,so that it is possible to manually exchange the lock lever.

In addition, when the switch 47 has been not stop the motor 1 in the condition of FIG. 6, the motor 1 rotates the fan shaped arm 9 counterclockwise attaining the condition shown in FIG. 7. Thus, it is possible to directly change the lock device to its unlocked condition.

What is claimed is:

1. A super-lock mechanism of a vehicular door lock device; comprising:

a motor carrying out a locking rotation and unlocking rotation, a lock lever displaceable between a locked position and an unlocked position due to a rotation of the motor, a movement member connected to said lock lever, a block member moving to the movement member due to a locking rotation of said motor and engaging with the movement member, wherein, when the motor carries out said locking rotation, the movement member and the block member engage with each other to produce a super-lock condition wherein an exchange of a lock lever cannot be achieved, wherein the block member is urged in a direction separating the block member from the movement member by means of a first spring, wherein the movement member has an engagement body keeping an engagement condition of the block member and the movement member against a resilient force of said first spring after the movement member engages with the block member, said super-lock mechanism further comprising an output member provided between the motor and the lock lever, wherein the engagement body is slidably held by the movement member, and has one end adapted to engage with said output member and another end engaged with said block member, said output member and the lock lever engaged with each other leaving a predetermined gap, wherein when the motor rotates the output member in an unlocking direction when in said super-lock condition, the engagement body is moved by the output member disengaging said engagement body from the block member before the output member engages with the lock lever.

2. The super-lock mechanism of a vehicular door lock device, according to claim 1, wherein the output member is held at a neutral position due to a second spring when the motor is not driven.

3. A super-lock mechanism of a vehicular door lock device; comprising:

a rotary shaft rotatable by a motor and having a first gear located at a center portion of said shaft and a second gear at a distal end of said shaft, a fan shaped arm engaged with the first gear and returnable to a neutral position, said fan shaped arm having a first long hole and a second long hole, a lock lever engageable with the first long hole of the fan shaped arm and displacable to a locked position and an unlocked position, a movement member connected to said lock lever and having a first dent, said movement member transversely moving when the lock lever is displaced, a pressing body engaged with said second gear and moving along a generally longitudinal direction, a block member connected to the pressing body through a first spring so as to make the block body intimately contact with the pressing body, said block member having a head portion engageable with the first dent of the movement member, said block having a second dent, a slider supported on the movement member transversally-slidable and having an end engageable with the second long hole and another end engageable with the second dent of the block member, said slider being urged toward the block member due to a second spring, wherein, when the lock lever is displaced to said locked position by means of the motor through said fan shaped arm, the movement member and said slider move transversely while the block member simultaneously moves longitudinally, the head portion of the block member engaging with the first dent of the movement member and another end of the slider engaging in the second dent of the block member to attain a super-lock condition of the lock device wherein an exchange of the lock lever cannot be achieved, wherein when the fan shaped arm rotates in an unlocking direction at the super-lock condition, the second long hole engages with said end of the slider in order to disengage another end of the slider from the second dent of the block member before said first long hole engages with the lock lever.

* * * * *